US006847726B2

(12) United States Patent
Button et al.

(10) Patent No.: US 6,847,726 B2
(45) **Date of Patent: *Jan. 25, 2005**

(54) SHORTING RINGS IN DUAL-COIL DUAL-GAP LOUDSPEAKER DRIVERS

(75) Inventors: Douglas J. Button, Los Angeles, CA (US); Ralph E. Hyde, Santa Clarita, CA (US); Alex V. Salvatti, Northridge, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/410,005

(22) Filed: Apr. 9, 2003

(65) Prior Publication Data

US 2003/0190052 A1 Oct. 9, 2003

Related U.S. Application Data

(63) Continuation of application No. 09/271,686, filed on Mar. 18, 1999, now Pat. No. 6,768,806.

(60) Provisional application No. 60/078,623, filed on Mar. 19, 1998.

(51) Int. Cl.[7] ..... H04R 25/00

(52) U.S. Cl. ..... 381/401; 381/396; 381/412; 381/414

(58) Field of Search ..... 381/400–402, 381/412, 414, 420–421, FOR 154, FOR 155, FOR 159

(56) References Cited

U.S. PATENT DOCUMENTS

| | | | | | |
|---|---|---|---|---|---|
| 3,632,904 | A | * | 1/1972 | Mauz | 381/414 |
| 3,665,352 | A | * | 5/1972 | Dietrich et al. | 335/231 |
| 3,783,311 | A | * | 1/1974 | Sato et al. | 310/27 |
| 3,830,986 | A | * | 8/1974 | Yamamuro | 381/414 |
| 3,867,587 | A | * | 2/1975 | Yamamuro | 381/414 |
| 3,881,074 | A | * | 4/1975 | Kawamura | 381/414 |
| 3,922,501 | A | * | 11/1975 | Yamamuro | 381/414 |
| 4,289,937 | A | * | 9/1981 | Ikeda et al. | 381/414 |
| 4,783,824 | A | * | 11/1988 | Kobayashi | 381/402 |
| 4,914,707 | A | * | 4/1990 | Kato et al. | 381/86 |
| 5,381,483 | A | * | 1/1995 | Grau | 381/414 |
| 5,715,324 | A | * | 2/1998 | Tanabe et al. | 381/412 |
| 5,815,587 | A | * | 9/1998 | Goller | 381/412 |

FOREIGN PATENT DOCUMENTS

| | | | |
|---|---|---|---|
| JP | 61-137496 | * | 6/1986 |
| JP | 6-014393 | * | 1/1994 |
| JP | 6-054398 | * | 2/1994 |

* cited by examiner

*Primary Examiner*—Curtis Kuntz
*Assistant Examiner*—Phylesha Dabney
(74) *Attorney, Agent, or Firm*—Brinks Hofer Gilson & Lione

(57) ABSTRACT

Loudspeaker and other transducers of the dual-voice-coil/dual-magnetic-gap type can be improved by the addition of one or more annular shorting rings strategically located in the vicinity of the two magnetic gaps. The shorting rings have no effect on a steady state magnetic field but act in opposition to any change in flux density or any displacement of the flux lines such as those that occur under the loading imposed when the voice coils are driven hard with audio frequency current. The location of the shorting rings determines their effect: location close to a voice coil reduces the voice coil inductance, location entirely within the magnetic flux loop centerline favors reduction of second harmonic distortion and higher order even harmonic distortion, a centered location on the flux loop centerline, i.e. centered in the magnetic gap, favors reduction of third harmonic and higher odd order harmonic distortion, while location outside the flux loop as defined by its center line but near the voice coil acts to generally reduce harmonic distortion and reduce the voice coil inductance. Thus a plurality of rings can be strategically deployed at different locations so as to optimally suppress both even and odd order harmonic distortion and to reduce the voice coil inductance.

60 Claims, 4 Drawing Sheets

SHORTING RINGS IN DUAL-COIL DUAL-GAP LOUDSPEAKER DRIVERS

PRIORITY AND CROSS REFERENCE TO RELATED APPLICATION

This is a continuation of U.S. application Ser. No. 09/271,686 filed Mar. 18, 1999 (U.S. Pat. No, 6,768,806), which claims the benefit under 35 U.S.C. § 119(e) of provisional application No. 60/078,623 filed Mar. 19, 1998, both of which are incorporated herein in their entirety by reference.

FIELD OF THE INVENTION

The present invention relates to the field of electromagnetic transducers and actuators, and more particularly it relates to improvements in loudspeaker drivers of the type having dual voice coils axially located in corresponding dual annular magnetic air gaps on a common axis.

BACKGROUND OF THE INVENTION

In addressing fundamental design issues of dual-voice-coil dual magnetic-gap loudspeaker drivers as related to conventional single-voice-coil drivers, the present inventors have found that the dual-voice-coil dual-gap type offers advantages with regard to linearity, efficiency, available voice coil excursion, power compression, heat dissipation and maximum sound pressure output capability. Furthermore, they have found that certain benefits of the dual-coil dual gap approach can be further enhanced by introducing shorting rings in the region of the two magnetic gaps near the voice coils.

DISCUSSION OF RELATED KNOW ART

Japanese patent 61-137496 to Okada introduces a conductive annular plate in a speaker magnet structure to prevent burning of a voice coil and to prevent an eddy current giving adverse influences to a voice coil current.

U.S. Pat. No. 5,381,483 to Grau discloses a minimal inductance electrodynamic transducer having ferromagnetic shunting rings coated with a highly conductive material to increase the induced current carrying capacity of the transducer.

U.S. Pat. No. 3,830,986 to Yamamuro discloses a MAGNETIC CIRCUIT FOR AN ELECTRO-ACOUSTIC CONVERTER having an air gap formed of a magnetic material laminated with a conductive layer for acting as shorting rings to decrease the inductance of the voice coil.

Japanese patent WO 81/02501 discloses a MAGNETIC CIRCUIT FOR AN ELECTRO-MECHANICAL TRANSDUCER OF A DYNAMIC ELECTRICITY TYPE wherein compensating coils or conductors within the magnetic gaps are supplied with signal current to prevent disturbances in the magnetic field.

Japanese patent 198208 discloses an ELECTROMAGNETIC CONVERTER wherein a magnetic ring is located in the air gap so that it can be moved axially between a circumferential yoke and a center yoke to provide good conversion efficiency by using a hollow disk permanent magnet that is magnetized in different poles at the center and external circumference.

U.S. Pat. No. 3,783,311 to Sato et al. discloses a MAGNETIC DEVICE FOR USE IN ACOUSTIC APPARATUS wherein a metallic member in a voice coil gap permits the lines of magnetic force to move substantially in one direction only, for distortion reduction.

Soviet Union patent 587645/SU197801 to Rotshtein for an electromagnetic loudspeaker magnetic circuit disclose a magnetic shunt of soft magnetic material placed over a core pole piece to increase acoustic pressure by decreasing magnetic resistance.

The foregoing patents are confined to conventional loudspeaker driver/actuator construction having only a single gap and sing voice coil.

Patents that disclose dual voice coil dual magnetic gap drivers/actuators include U.S. Pat. Nos. 4,612,592 to Frandsen, 5,231,336 to Van Namen, and French patent 1,180,456 to Kritter; however, these do not disclose the use of shorting rings.

U.S. Pat. No. 4,914,707 to Kato et al. for a BALANCE VEHICULAR SPEAKER SYSTEM suggests attaching a shorting ring to a coil of a dual-coil dual-gap front speaker in a vehicle to decrease the high frequency impedance as an alternative to connecting a resistor in series with a rear speaker, for purposes of making the impedance of the rear speaker higher than that of the front one.

OBJECTS OF THE INVENTION

It is a primary object of the present invention to provide improvements in a dual-voice-coil/dual-magnetic-gap type transducer that will reduce harmonic distortion in the acoustic output.

It is a further object of the present invention to implement the aforementioned improvements in a manner that will reduce even order harmonic distortion including particularly second harmonic distortion.

It is a still further object of the present invention to implement the aforementioned improvements in a manner that will reduce odd order distortion including particularly third harmonic distortion.

SUMMARY OF THE INVENTION

The above-mentioned objects have been accomplished and the advantages have been realized by the present invention as applied as an improvement to loudspeakers and other transducers of the dual-voice-coil/dual-magnetic-gap type by the addition of one or more shorting rings of high conductivity metal strategically located in the vicinity of the two magnetic gaps close to the voice coils and secured in place in fixed relationship relative to the main structure of the loudspeaker or transducer.

The shorting rings have no effect on a steady state magnetic field but act in opposition to any change in flux density or any displacement of the flux lines such a those that occur under the loading imposed when the voice coils are driven hard with audio frequency current. The location of the shorting rings determines their effect: location close to a voice coil reduces the voice coil inductance, location entirely within the magnetic flux loop centerline favors reduction of second harmonic and higher order even harmonic distortion, a centered location on the flux loop centerline, i.e. centered in the magnetic gap, favors reduction of third harmonic and higher order odd harmonic distortion, while location outside the flux loop centerline but near the voice coil acts to generally reduce harmonic distortion. Thus a plurality of rings can be differently located so as to optimally suppress both even and odd order harmonic distortion and reduce the voice coil inductance.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
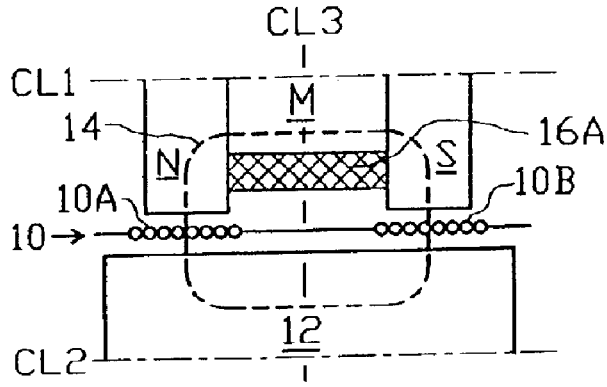
FIGS. 1–3 show shorting rings located inside the flux loop for reducing even order harmonic distortion.

FIGS. 1–12 are basic functional representations of a dual-gap dual-voice-coil loudspeaker driver, shown in half cross-section with a voice coil assembly 10 carrying voice coils 10A and 10B suspended in a pair of magnetized air gaps formed from a permanent magnet M disposed between a first steel pole N, at the north poles of magnet M, and a second steel pole S at the south end of magnet M, and a yoke 12 which is made of magnetic material and which can be considered to define, in effect, a pair of pole faces that would substantially mirror the articulated pole pieces N and S of magnet M and thus form the two magnetic gaps.

The magnetic system of the foregoing structure sets up a magnetic flux loop in the path shown as a dashed line, i.e. flux loop center line 14, which is typically centered within each magnetic gap and within each voice coil 10A and 10B.

Voice coil assembly 10 is constrained by well known spring suspension diaphragm structure (not shown) so that it travels axially, typically driving a conventional speaker cone diaphragm (not shown) in response to AC (alternating current) applied to coils 10A and 10B, in accordance with the well known Right Hand rule of electromagnetic mechanics and in the general manner of loudspeakers, the two coils being phase-connected accordingly.

The half cross-section shown in FIGS. 1–12 represents a coaxial loudspeaker motor structure that can have either of two basic configurations that are inverse of each other:

(1) coaxial about center line CL1 with magnet M inside of the annular voice coil assembly 10 so that magnet M with pole pieces N and S are cylindrical in shape while yoke 12 is tubular in shape surrounding voice coil assembly 10; or (2) coaxial about center line CL2 with a cylindrical yoke 12 inside voice coil assembly 10, and magnet M and pole pieces N and S being annular in shape, surrounding voice coil assembly 10.

A common inherent shortcoming in loudspeakers is that the magnetic flux in the region of the voice coil(s) is subject to pattern deformation or modulation as a reaction to drive current in the voice coil(s); this in turn can distort the acoustic output as well as increase the inductance of the coil winding(s), altering the frequency response.

As indicated in the above discussion of related known art, it has been found that the introduction of shorting/shunting rings of highly conductive metal such as copper in the vicinity of the magnetic air gap of conventional single coil drivers can provide benefits by acting to stabilize the magnetic flux against such perturbation from modulation due to voice coil current. Such shorting rings have no effect on the flux pattern as long as it remains constant and stationary, however the rings react with an internal flow of current that opposes any change in the flux pattern such as would be caused by the drive current in voice coils, thus the rings can substantially reduce distortion in the acoustic output. Also a shorting ring located near a voice coil tends to reduce the inductance of the voice coil.

The present inventors, in research directed to improvements in dual-gap dual-coil transducer drivers, have identified key locations and configurations for such shorting rings, particularly with regard to distortion reduction, and have developed such locations and configurations for reducing second and/or third harmonic distortion selectively.

Figure 2:
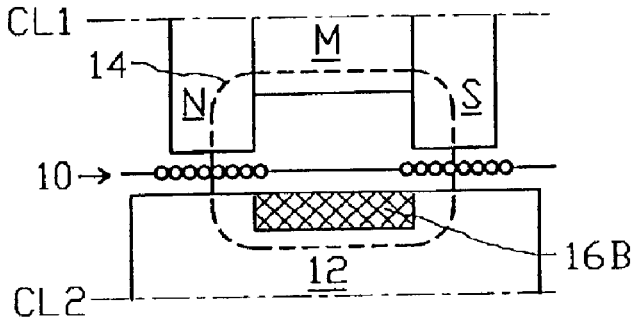
Figure 3:
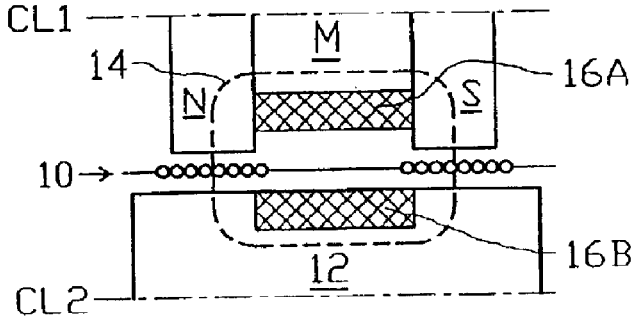

FIGS. 1–3 show locations of tubular-shaped shorting rings that are located within the flux loop as defined by its center line 14 and that therefore act in a manner to reduce even order harmonic distortion including particularly second harmonic distortion in accordance with the present invention.

In FIG. 1, the tubular shorting ring 16A is located adjacent to permanent magnet M, essentially extending between the two pole pieces N and S in a location adjacent to voice coil assembly 10 and entirely within the flux loop defined by center line 14. In FIG. 2, the tubular shorting ring 16B is embedded in a recessed region of yoke 12, essentially extends between the two yoke pole faces in a location adjacent to voice coil assembly 10 and entirely within the flux loop defined by center line 14. In FIG. 3, two rings are incorporated in a driver unit: ring 16A, as in FIG. 1 and ring 16B, as in FIG. 2; since both rings are located within the flux loop defined by center line 14, the even order harmonic distortion suppression is greater than in either FIG. 1 or FIG. 2.

Figure 4:
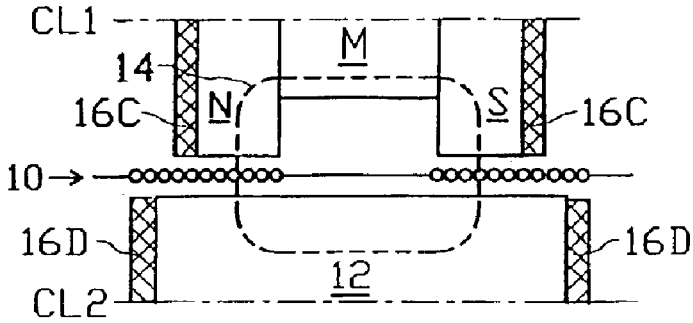
FIGS. 4–5 show shorting rings located outside the flux loop.
Figure 5:
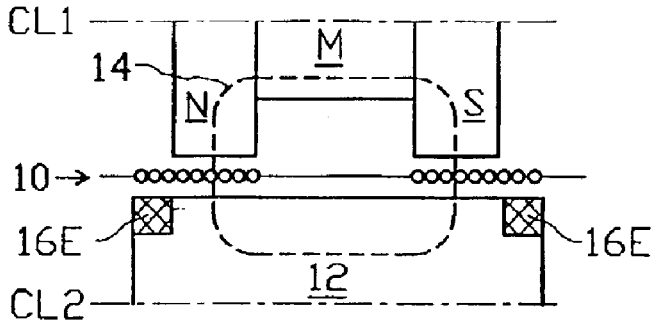

FIGS. 4 and 5 show locations of annular shorting rings 16D and 16E configured as disks that have an edge positioned close to the voice coils of assembly 10 and that, being located outside the flux loop center line 14, act generally to reduce harmonic distortion and reduce voice coil inductance in accordance with the present invention.

In FIG. 4 a first pair of shorting rings 16C are located on the outer surfaces of pole pieces N and S respectively and a second pair of shorting rings 16D are located on each end of yoke 12, all having an edge in close proximity to the voice coils of assembly 10. The shorting rings 16C and 16D are shaped as annular disks, i.e. flat washers, however, depending on the configuration, i.e. whether CL1 or CL2 is the central axis, the pair of shorting rings that are centered on the axis need not have a central hole and thus could be shaped simply as circular disks.

In FIG. 5, two shorting rings 16E are fitted in the outer corners of yoke 12, in close proximity to the voice coils of assembly 10, but outside the flux loop as defined by center line 14.

Figure 6:
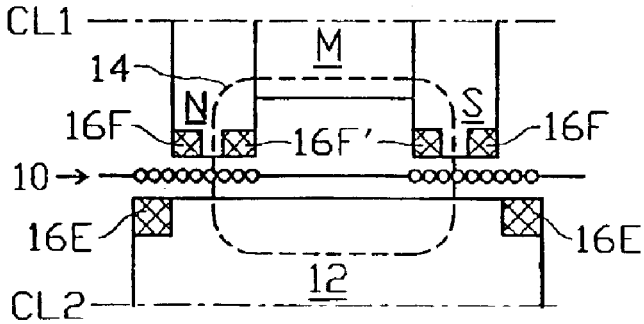
FIGS. 6–7 show at least two shorting rings located inside the flux loop and at least two located outside the flux loop.
Figure 7:
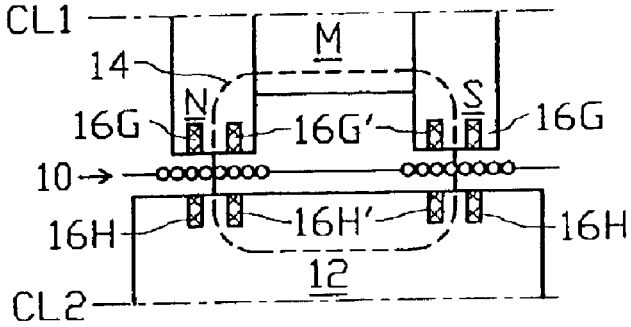

FIGS. 6 and 7 show configurations with shorting ring locations near the voice coils both inside and outside the flux loop as defined by center line 14, thus acting mainly to suppress second harmonics and higher order even harmonics and to reduce voice coil inductance.

In FIG. 6, two shorting rings 16F' are located in the inner corners or each of the magnet pole pieces N and S, within the flux loop and acting mainly on even order harmonics, while two rings 16F are located in the outer corners of the magnet pole pieces N and S and two rings 16E are located in the outer corners of the yoke, as in FIG. 5, these four rings, being located outside the flux loop but close to the voice coils of assembly 10, will thus act generally to reduce harmonic distortion and reduce the inductance of the voice coils.

In FIG. 7, a total of eight rings are deployed; a pair of shorting rings 16G and 16G' embedded in each of the pole pieces N and S as shown, and two corresponding pairs of shorting rings 16H and 16H' embedded in corresponding locations in yoke 12, so that four of the rings are inside the flux loop and the other four are outside the flux loop.

Figure 8:
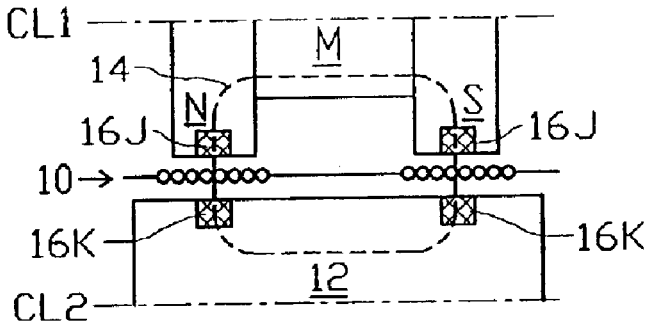
FIGS. 8–10 show shorting rings centered on the flux loop for best suppression of odd order harmonics.
Figure 9:
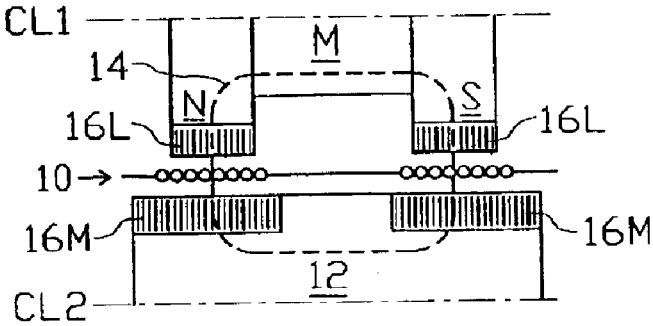
Figure 10:
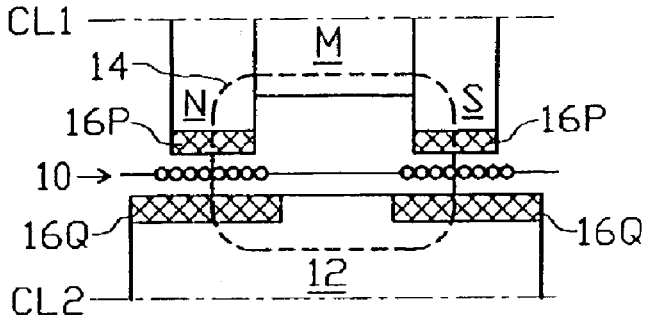

FIGS. 8–10 show shorting rings located substantially centered on the flux loop center line 14: this is the optimal location for suppression of odd order harmonics, particularly third harmonics.

In FIG. 8, shorting rings 16J and 16K are embedded in a center location, one each in all four pole faces defining the two magnetic gaps, substantially centered on the flux loop center line 14.

In FIG. 9, the total faces of poles N and S are configured with laminated shorting ring structures 16L, and corresponding laminated shorting structures 16H are embedded in the upper pole face regions of yoke 12 adjacent the voice coils as shown. These laminated shorting ring structures 16L and 16H consist of sheets of electrically conductive metal (typically copper or aluminum) interleaved with magnetic grade steel laminations. This approach represents the closest possible approach to ideal conditions for reducing acoustic distortion, both second and third harmonics and their higher order multiples, and reducing voice coil inductance, since the laminated shorting rings act in the manner of a large number of individual shorting rings, some located outside the flux loop, some centered thereon and some located outside the flux loop, but all located close to the voice coils. This type of shorting ring is particularly beneficial at higher audio frequencies.

FIG. 10 depicts essentially an unlaminated version of FIG. 9: lower faces of pole pieces N and S are fitted with embedded shorting rings 16Q of tubular shape, somewhat longer that rings 16P and thus extending inwardly from the outer corners past the voice coils of assembly 10, acting to lower the voice coil inductance as well as to reduce harmonic distortion optimally.

Figure 11:
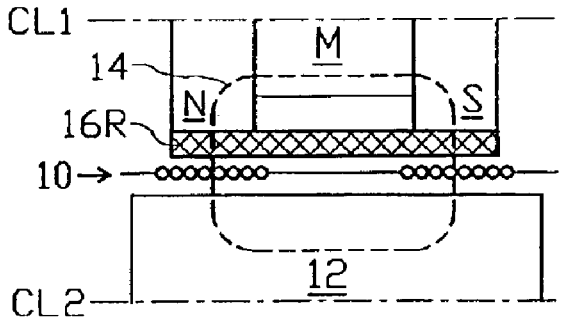
FIGS. 11 and 12 show shorting rings in tubular form extending through both gaps.

In FIG. 11, a single tubular shorting ring 16R extending full length of the magnet assembly including a surface layer added onto the faces of pole pieces N and S close to the voice coils, thus acting to reduce voice coil inductance as well as to reduce harmonic distortion.

Figure 12:
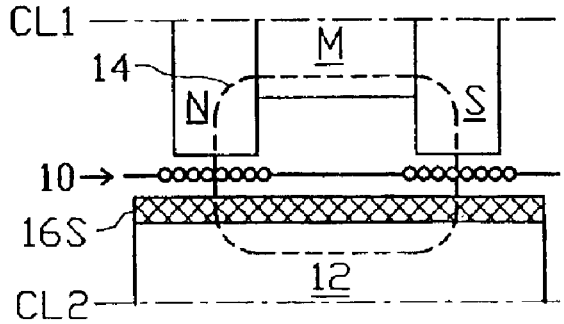

FIG. 12 depicts essentially a version of FIG. 11 with the tubular shorting ring 16S deployed as a surface layer extending full length along the upper surface of yoke 12 including its pole regions, close to the voice coils, thus providing further reduction in voice coil inductance.

Alternative viable combinations of FIGS. 10–12 include: ring 16R (FIG. 11) deployed in place of rings 16P in FIG. 10; ring 16S (FIG. 12) deployed in place of rings 16Q in FIG. 10; ring 16S (FIG. 12) deployed in yoke 12 in FIG. 11.

In the various shorting ring patterns, suppression of harmonic distortion generally becomes more effective as the ring(s) are made more massive and/or numerous.

Shorting rings are most effective in reducing harmonic distortion in the audio frequency range 200 to 2,000 Hertz.

Typical results in distortion reduction were measured as follows:

| Frequency: | 200 Hz | 500 Hz | 1 KHz |
|---|---|---|---|
| 1. Ring Configuration: FIG. 1 and FIG. 5 combined; | | | |
| 2nd harmonic reduction | 5 db | 6 db | 14 db |
| 3rd harmonic reduction | 11 db | 10 db | 2 db |
| 2. Ring Configuration: FIG. 5; | | | |
| 2nd harmonic reduction | no appreciable reduction | | |
| 3rd harmonic reduction | 9 db | 4 db | 2 db |

This invention may be embodied and practiced in other specific forms without departing from the spirit and essential characteristics thereof. The present embodiments therefore are considered in all respects as illustrative and not restrictive. The scope of the invention is indicated by the appended claims rather that by the foregoing description. All variations, substitutions, and changes that come within the meaning and range or equivalency of the claims therefore are intended to be embraced therein.

What is claimed is:

1. An improved loudspeaker driver structure, for driving a vibratable diaphragm to produce sound, comprising:

first and second similar annular voice coils, located spaced apart end-to-end on a tubular voice coil form as part of a coaxial voice coil assembly that is disposed about a central axis, drivingly coupled to the diaphragm and resiliently constrained to be vibratable only in a longitudinal direction of the axis;

a first annular interfacing pair of magnetic pole faces, configured and arranged to form a first annular magnetic gap traversing a predetermined annular portion of the first voice coil;

a second annular interfacing pair of magnetic pole faces, configured and arranged to form a second annular magnetic gap traversing a predetermined annular portion of the second voice coil;

a permanent magnet having a first magnetic pole defining a first pole piece, and having a second magnetic pole defining a third pole piece;

a magnetic yoke having a first end defining a second pole piece and having a second end defining a fourth pole piece, the first and second pole pieces forming the first annular interfacing pair of magnetic pole faces and the third and fourth pole pieces forming the second annular interfacing pair of magnetic pole faces, the magnet completing a flux loop encompassing, in series: (a) the magnet, (b) the first pole piece, (c) the first magnetic gap, traversing the first voice coil, (d) the second pole piece, (e) the yoke, (f) the fourth pole piece, (g) the second magnetic gap, traversing the second voice coil, and (h) the third pole piece; and at least one conductive metal annular shorting ring, disposed coaxially and configured in a tubular form located in coupled relationship with the flux loop and proximate to both the first and second similar annular voice coils and the first and second annular interfacing pair of magnetic pole faces so as to react to current in the first and second annular voice coils in a manner to reduce harmonic distortion in acoustic output of the loudspeaker where the at least one shorting ring extends across one of both the first and third pole pieces or the second and fourth pole pieces so as to constitute a surface layer extending between each pole piece and extending on each pole piece.

2. The improved loudspeaker driver structure of claim 1 comprising a single annular shorting ring, disposed adjacent to said magnet between the magnet and the voice coil form, and extending substantially between the first and third pole pieces.

3. The improved loudspeaker driver structure of claim 1 comprising a single annular shorting ring disposed adjacent to said yoke between the yoke and the voice coil form, and extending substantially between the second and fourth pole pieces.

4. The improved loudspeaker driver structure of claim 3 further comprising a single annular shorting ring, disposed adjacent to the magnet, between the magnet and the voice coil form, and extending substantially between the first and third pole pieces.

5. The improved loudspeaker driver structure of claim 1 comprising at least two annular rings, each disposed in a substantially symmetric manner about a center line of the magnetic flux loop, so as to particularly reduce odd order harmonic distortion in acoustic output.

6. The improved loudspeaker driver structure of claim 5 where each of the at least two annular shorting rings is configured in tubular form constituting, in effect, a surface layer on a corresponding one of the first, second, third and fourth pole pieces.

7. The improved loudspeaker driver structure of claim 5 where each of the at least two annular shorting rings is embedded in a central surface region of a corresponding one of the first, second, third and fourth pole pieces.

8. The improved loudspeaker driver structure of claim 1 where the at least one annular shorting rings is fabricated from a stack of individually isolated laminations of magnetic grade steel.

9. The improved loudspeaker driver structure of claim 1 comprising:

at least one annular shorting ring disposed entirely within the magnetic flux loop as defined by a center line, so as to act in a manner to particularly reduce even order harmonic distortion in the acoustic output; and at least one annular shorting ring disposed outside the magnetic flux loop as defined by the center line.

10. The improved loudspeaker driver structure of claim 9 comprising eight annular shorting rings of which two are disposed in each of the first second, third and fourth pole pieces in opposite regions thereof such that four outermost of the shorting rings are disposed outside the magnetic flux loop as defined by the center line, and four innermost of the shorting rings are disposed within the flux loop center line.

11. The improved loudspeaker driver structure of claim 1 where the at least one annular shorting ring is disposed substantially outside the magnetic flux loop as defined by a flux loop center line.

12. The improved loudspeaker driver structure of claim 11, further comprising two annular rings, each having a narrow width being less than half a voice coil length, and each being disposed outside the flux loop center line, as follows:

a first annular shorting ring disposed along an outermost edge of the first pole piece, adjacent the voice coil form; and a second annular shorting ring disposed along an outermost edge of the third pole piece, adjacent the voice coil form.

13. The improved loudspeaker driver structure of claim 11, further comprising two annular rings, each having a narrow width being less than half a voice coil length, and each disposed outside the flux loop as follows:

a first annular shorting ring disposed along an outermost edge of the second pole piece, adjacent the voice coil form; and a second annular shorting ring disposed along an outermost edge of the pole piece, adjacent the voice coil form.

14. The improved loudspeaker driver structure of claim 11 comprising four annular rings, each disposed outside the flux loop as follows:

a first annular shorting ring disposed along an outermost end of the first pole piece, extending close to the voice coil form;

a second annular shorting ring disposed along an outermost end of the second pole piece, extending close to the voice coil form;

a third annular shorting ring disposed along an outermost end of the third pole piece, extending close to the voice coil form; and a fourth annular shorting ring disposed along an outermost end of the fourth pole piece, extending close to the voice coil form.

15. A loudspeaker drive motor, comprising, a first magnetic pole piece;

a second magnetic pole piece;

a magnet in between the first and second pole pieces;

a yoke having a first end and a second end;

a first magnetic gap formed between the first pole piece and the first end of the yoke;

a second magnetic gap formed between the second pole piece and the second end of the yoke;

a gap extending between the first and second magnetic gaps, wherein the first and second magnetic gaps are adapted to receive dual-voice coils, a magnetic flux loop formed through the magnet, the first pole piece, the first magnetic gap, the first end of the yoke, the yoke, the second end of the yoke, the second magnetic gap, and the second pole piece;

a first shorting ring fixedly adjacent to both of the first and second magnetic gaps to oppose changes in intensity or location of the magnetic flux from the magnet, thereby reducing distortion, where the first shorting ring is positioned proximate the yoke and at least entirely within the magnetic flux loop or at least entirely outside of the magnetic flux loop.

16. The loudspeaker driver motor of claim 15, wherein the first shorting ring is within the magnetic flux loop between the first and second pole pieces to reduce even order harmonic distortion.

17. The loudspeaker driver motor of claim 15 wherein the first shorting ring is within the magnetic flux loop and recessed within the yoke to reduce even order harmonic distortion.

18. The loudspeaker driver motor of claim 16, including a second shorting ring within the magnetic flux loop and recessed within the yoke.

19. The loudspeaker driver motor of claim 15, wherein the first shorting ring is outside of the magnetic flux loop to reduce harmonic distortion and voice coil inductance.

20. The loudspeaker driver motor of claim 19, including a second shorting ring within the magnetic flux loop.

21. The loudspeaker driver motor of claim 15, wherein the first shorting ring extends at least between the first and second magnetic gaps.

22. A loudspeaker driver, comprising:

a yoke;

a magnet having a first pole and a second pole, where the first pole is positioned relative to the yoke to define a first gap and the second pole is positioned relative to the yoke to define a second gap;

a first coil positioned in the first gap;

a second coil positioned in the second gap, where the first coil and the second coil are configured to set up a magnetic flux loop, the magnetic flux loop defines a center line, and the center line separates a magnetic flux loop interior from a magnetic flux loop exterior; and a shorting ring positioned proximate both the first gap and the second gap and within one of the magnetic flux loop interior and the magnetic flux loop exterior.

23. The loudspeaker driver of claim 22, wherein the shorting ring is positioned completely within one of the magnetic flux loop interior and the magnetic flux loop exterior.

24. The loudspeaker driver of claim 22, wherein the shorting ring is positioned within the magnetic flux loop interior.

25. The loudspeaker driver of claim 24, wherein the shorting ring is positioned completely within the magnetic flux loop interior.

26. The loudspeaker driver of claim 24, wherein the yoke comprises a recess and the shorting ring is embedded in the recess of the yoke.

27. The loudspeaker driver of claim 24, wherein the shorting ring is positioned adjacent to the magnet.

28. The loudspeaker driver of claim 27, wherein the shorting ring is positioned between the first pole and the second pole.

29. The loudspeaker driver of claim 27, wherein the shorting ring is positioned in physical contact against the magnet.

30. The loudspeaker driver of claim 27, wherein the shorting ring is a first shorting ring, the loudspeaker driver further comprising a second shorting ring embedded in a recess of the yoke.

31. The loudspeaker driver of claim 24, wherein the shorting ring is embedded in one of the first pole and the second pole.

32. The loudspeaker driver of claim 31, wherein the shorting ring is a first shorting ring embedded in at least an inner corner of the first pole, the loudspeaker driver further comprising a second shorting ring embedded in at least inner corner of the second pole.

33. The loudspeaker driver of claim 24, wherein the shorting ring is embedded in the yoke at a position that is adjacent to one of the first gap and the second gap.

34. The loudspeaker driver of claim 33, wherein the shorting ring is a first shorting ring embedded in the yoke at the position that is adjacent to the first gap, the loudspeaker driver further comprising a second shorting ring embedded in the yoke at the position that is adjacent to the second gap.

35. The loudspeaker driver of claim 33, wherein the shorting ring is a first shorting ring embedded in the yoke at a position that is adjacent to one of the first gap and the second gap, the loudspeaker driver further comprising a second shorting ring embedded in one of the first pole and the second pole.

36. The loudspeaker driver of claim 22, wherein the shorting ring is positioned completely within the magnetic flux loop exterior.

37. The loudspeaker driver of claim 36, wherein the shorting ring is embedded in one of the first pole and the second pole.

38. The loudspeaker driver of claim 37, wherein the shorting ring is a first shorting ring embedded in at least an outer corner of the first pole, the loudspeaker driver further comprising a second shorting ring embedded in at least an outer corner of the second pole.

39. The loudspeaker driver of claim 36, wherein the shorting ring is embedded in the yoke at a position that is adjacent to one of the first gap and the second gap.

40. The loudspeaker driver of claim 39, wherein the first pole is a first pole piece, the second pole is a second pole piece, the loudspeaker driver further comprises a second shorting ring embedded in one of the first pole and the second pole.

41. The loudspeaker driver of claim 36, wherein the first coil additionally is positioned remote from the first gap, the second coil additionally is positioned remote from the second gap, and the shorting ring is embedded in the yoke at a position that is remote from one of the first gap and the second gap.

42. The loudspeaker driver of claim 41, wherein the shorting ring is a first shorting ring embedded in the yoke at the position that is remote from the first gap, the loudspeaker driver further comprising a second shorting ring embedded in the yoke at the position that is remote from the second gap.

43. The loudspeaker driver of claim 42, wherein the shorting ring is a first shorting ring embedded in the yoke at the position that is remote from one of the first gap and the second gap, the loudspeaker driver further comprising a second shorting ring embedded in one of the first pole and the second pole.

44. The loudspeaker driver of claim 22, wherein the shorting ring is a first shorting ring positioned within the magnetic flux loop interior, the loudspeaker driver further comprising a second shorting ring.

45. The loudspeaker driver of claim 44, wherein the first shorting ring is positioned completely within the magnetic flux loop interior.

46. The loudspeaker driver of claim 22, wherein the second shorting ring is positioned within the magnetic flux loop exterior.

47. The loudspeaker driver of claim 46, wherein the second shorting ring is positioned completely within the magnetic flux loop exterior.

48. The loudspeaker driver of claim 47, wherein the first shorting ring is embedded in one of the first pole, the second pole, the first end of the yoke, and the second end of the yoke, and the second shorting ring is embedded in one of the first pole, the second pole piece, the first end of the yoke, and the second end of the yoke.

49. The loudspeaker driver of claim 48, further comprising at least one of:

a third shorting ring embedded one of the first pole, the second pole, the first end of the yoke, and the second end of the yoke; and a fourth shorting ring embedded in one of the first pole, the second pole, the first end of the yoke, and the second end of the yoke.

50. The loudspeaker driver of claim 22, wherein the shorting ring comprises a plurality of conductive sheets interleaved with a plurality of magnetic laminations.

51. A loudspeaker driver, comprising:

a yoke;

a magnet having a first pole and a second pole, where the first pole is positioned relative to the yoke to define a first gap and the second pole is positioned relative to the yoke to define a second gap;

a first coil positioned in the first gap;

a second coil positioned in the second gap, where the first coil and the second coil are configured to set up a magnetic flux loop, the magnetic flux loop defines a center line, and the center line separates a magnetic flux loop interior from a magnetic flux loop exterior; and a first shorting ring having a first edge and a second edge, where the shorting ring defines a ring center line extending between the first edge and the second edge, the shorting ring being positioned proximate the first coil so that the center line of the magnetic flux loop passes approximately through the first shorting ring center line.

52. The loudspeaker driver of claim 51, wherein the first shorting ring is embedded in a recess of the yoke at the position that is adjacent to one of the first gap and the second gap.

53. The loudspeaker driver of claim 51, wherein the first shorting ring is embedded in one of the first pole and the second pole.

54. The loudspeaker driver of claim 53, further comprising a second shorting ring embedded in a recess of the yoke.

55. The loudspeaker driver of claim 54, wherein the second shorting ring is embedded in a recess of the yoke so as to span from the first gap to the second gap.

56. The loudspeaker driver of claim 55, wherein the first shorting ring is embedded in the magnet so as to span from the first pole to the second pole.

57. The loudspeaker driver of claim 51, wherein the shorting ring comprises a plurality of conductive sheets interleaved with a plurality of magnetic laminations.

58. A loudspeaker driver, comprising:

a yoke having a first end and a second end;

a magnet having a first pole and a second pole, where the first pole is positioned relative to the first end of the yoke to define a first gap and the second pole is positioned relative to the second end of the yoke to define a second gap;

a first coil positioned in the first gap;

a second coil positioned in the second gap, where the first coil and the second coil are configured to set up a magnetic flux loop, the magnetic flux loop defines a center line, and the center line separates a magnetic flux loop interior from a magnetic flux loop exterior; and a shorting ring embedded in one of the magnet and the yoke, so as to span between the first gap and the second gap.

59. The loudspeaker driver of claim 58, wherein the shorting ring is a first shorting ring, the loudspeaker driver further comprising a second shorting ring embedded in one of the magnet and the yoke.

60. The loudspeaker driver of claim 58, wherein the shorting ring comprises a plurality of conductive sheets interleaved with a plurality of magnetic laminations.

* * * * *